US009878885B2

(12) United States Patent
Scheider et al.

(10) Patent No.: US 9,878,885 B2
(45) Date of Patent: Jan. 30, 2018

(54) CRANE CONTROLLER

(71) Applicant: Liebherr-Werk Nenzing GmbH, Nenzing (AT)

(72) Inventors: Klaus Scheider, Hergatz (DE); Oliver Sawodny, Stuttgart (DE); Ulf Schaper, Stuttgart (DE); Eckhard Arnold, Illmenau (DE)

(73) Assignee: LIEBHERR-WERK NENZING GMBH, Nenzing (AT)

( * ) Notice: Subject to any disclaimer, the term of this patent is extended or adjusted under 35 U.S.C. 154(b) by 10 days.

(21) Appl. No.: 14/322,459

(22) Filed: Jul. 2, 2014

(65) Prior Publication Data

US 2015/0012188 A1 Jan. 8, 2015

(30) Foreign Application Priority Data

Jul. 5, 2013 (EP) ..... 13003410

(51) Int. Cl.
*B66C 13/18* (2006.01)
*B66C 13/06* (2006.01)
(Continued)

(52) U.S. Cl.
CPC ..... *B66C 13/18* (2013.01); *B66C 13/063* (2013.01); *B66C 13/40* (2013.01); *B66C 23/82* (2013.01); *B66C 23/84* (2013.01)

(58) Field of Classification Search
CPC ..... B66C 13/18–13/38; B66C 13/40; B66C 13/063; B66C 23/82; B66C 23/84; B66C 13/06
See application file for complete search history.

(56) References Cited

U.S. PATENT DOCUMENTS 5,725,113 A * 3/1998 Habisohn ..... B66C 13/063 212/275
2005/0247657 A1* 11/2005 Sparenborg ..... B66C 13/16 212/325

(Continued)

FOREIGN PATENT DOCUMENTS

DE 10 2006 048988 A1 4/2008
EP 2 272 784 A1 1/2011
WO 2004/106215 A1 12/2004

*Primary Examiner* — Genna M Mott
(74) *Attorney, Agent, or Firm* — Dilworth & Barrese, LLP.; Michael J. Musella, Esq.

(57) ABSTRACT

The present invention shows a crane controller for the semi-automatic control of a rotary crane, the crane comprising at least a slewing actuator for creating a slewing motion of the crane and/or a luffing actuator for creating a luffing motion of the crane, the crane controller comprising an input unit which can be operated by a operator to provide a desired slewing speed and/or a desired luffing speed as an operator input and a model-predictive reference trajectory planning module comprising an optimization unit for calculating a reference trajectory that obeys the system dynamics and follows the operator input, and a feedforward-controller using the reference trajectory for controlling the slewing actuator and/or the luffing actuator. Further, the optimization unit takes into account the deflection of the rope in the tangential and/or radial direction when solving the optimization problem that provides the reference trajectory.

22 Claims, 10 Drawing Sheets

(51) Int. Cl.

| | |
|---|---|
| ***B66C 13/40*** | (2006.01) |
| ***B66C 23/82*** | (2006.01) |
| ***B66C 23/84*** | (2006.01) |

(56) References Cited

U.S. PATENT DOCUMENTS

| | | | | |
|---|---|---|---|---|
| 2007/0219662 | A1* | 9/2007 | Sawodny | B66C 13/04 700/213 |
| 2009/0008351 | A1* | 1/2009 | Schneider | B66C 13/063 212/272 |
| 2011/0006025 | A1* | 1/2011 | Schneider | B66C 13/063 212/273 |
| 2014/0224755 | A1* | 8/2014 | Eriksson | B66C 13/06 212/273 |

* cited by examiner

Top view:

3D view:

CRANE CONTROLLER

BACKGROUND OF THE INVENTION

The present invention relates to a crane controller for the semi-automatic control of a rotary crane.

In the semi-automatic control of a crane, the operator will provide a desired slewing speed and/or a desired luffing speed as an operator input, and a model-predictive reference trajectory planning module of the crane controller will calculate a reference trajectory that obeys the system dynamics and follows the operator input. This reference trajectory will be used by a feedforward-controller for controlling the slewing actuator and/or the luffing actuator of the crane.

The trajectory planning module will use a physical model of the crane and/or of the load hanging from the crane, in order to generate a reference trajectory that obeys the system dynamics. Further, the reference trajectory planning module will use an optimization unit for calculating a reference trajectory that follows the operator input as quickly as possible.

In prior art crane controllers of this type, the optimization unit also takes into account the system limitations of the crane, in order to calculate a reference trajectory that the crane actuators can create. Further, it is known to use feedforward-controllers having anti-sway-control properties, and which take into account the pendulum dynamics of the load hanging from the crane in order to limit a swaying of the load during the movement of the crane. Further, some approaches try to minimize the acceleration of the load during optimization.

SUMMARY OF THE INVENTION

The present invention is now directed to improving a crane controller for the semi-automatic control of a rotary crane.

For this purpose, the present invention provides a crane controller for the semi-automatic control of a rotary crane, the crane comprising at least a slewing actuator for creating a slewing motion of the crane and a luffing actuator for creating a luffing motion of the crane. The crane controller of the present invention comprises an input unit which can be operated by an operator to provide a desired slewing speed and/or a desired luffing speed as an operator input, a model-predictive reference trajectory planning module comprising an optimization unit for calculating a reference trajectory that obeys the system dynamics and follows the operator inputs, and a feedforward-controller using the reference trajectory for controlling the slewing actuator and/or the luffing actuator. Further, according to the present invention, the optimization unit takes into account the deflection of the rope in the tangential and/or radial direction when solving the optimization problem that provides the reference trajectory.

The present invention provides a better anti-sway control than prior art crane controllers, in that the deflection of the rope and thereby the sway of the load is already taken into account during the optimization process that provides the reference trajectory. Thereby, the reference trajectory planning module of the present invention will provide a reference trajectory that will, when used as a basis for a feedforward-controller, provide a movement of the load with limited sway of the load.

In a preferred embodiment, the optimization unit of the present invention uses the maximum allowable deflection of the rope as a constraint when calculating the reference trajectory. Thereby, the optimization unit will make sure that the deflection of the rope will keep within some allowable limits. Because a deflection of the rope will create additional strain on the crane structure, this will allow to limit such strain to allowable values. Further, this will keep the sway of the rope within certain boundary limits.

In a further preferred embodiment, the optimization unit of the present invention uses a penalizing function for penalizing deflections of the rope and/or changes in the deflection of the rope when calculating the reference trajectory. Thereby, the optimization process will prefer reference trajectories that minimize the deflection of the rope and/or changes in the deflection of the rope. Thereby, the reference trajectory planning module will provide reference trajectories that minimize the sway of the load.

As stated above, the reference trajectory planning module of the present invention is model-predictive, i.e. it uses a physical model of the dynamics of the crane and/or of the load hanging from the crane. In particular, this physical model may describe the pendulum dynamics of a load hanging on a rope from the tip of the boom, and/or the dynamics of the crane in response to the control of the slewing and/or luffing actuator. In particular, the model may describe the slewing angle of the boom of the crane in dependence on the control signal of the slewing actuator, and/or the luffing angle of the boom of the crane in dependence on the control signal of the luffing actuator, and/or the slewing angle and/or radial position of the load depending on the slewing angle and/or the luffing angle of the crane and/or the control signal of the actuator.

The reference trajectory planning module uses this physical model as a further constraint during the optimization process, such that the reference trajectory obeys the system dynamics.

Apart from the feedforward controller that uses the reference trajectory, the crane controller may further comprise, in combination with the feedforward controller, a feedback-controller using one or more sensor signals for feedback-control of the crane. Using such a feedback-loop will stabilize the control of the crane. However, because the reference trajectory created by the present invention already takes into account the system dynamics, the final control signal will usually be dominated by the feedforward-control signal. Further, because the deflection of the rope is already taken into account during the optimization process that provides the reference trajectory, it is not necessary to include anti-sway control in the feedback-controller. However, in a preferred embodiment, also the feedback-controller includes anti-sway control to reject disturbances.

The feedback-controller may comprise a state observer for estimating the state of the crane system from the signals y of the one or more sensors and the control signals used for controlling the slewing actuator and/or the luffing actuator. This estimated state of the crane will then be compared with the reference trajectory in order to implement feedback control.

Such a combination of a feedforward-controller and a feedback-controller is preferred for implementing the present invention. However, the feedforward-controller of the present invention could also be used without a feedback-controller.

Further preferred features of the crane controller of the present invention, and in particular of the optimization unit used for creating the reference trajectories, will now be describes in the following:

In one embodiment, the optimization unit may use the maximum allowable amplitude and/or the maximum allowable change rate of the control signal for the slewing actuator and/or the luffing actuator as a constraint when solving the optimization problem that provides the reference trajectory. This will make sure that the system limitations, and in particular the limitations of the actuator and the limitations of the crane structure, are taken into account.

Preferably, if the maximum amplitude of the control signal is used as a constraint, the optimization unit takes into account a possible control input from the feedback-controller. Otherwise, if the reference trajectory is allowed to use the maximum allowable amplitude of the control signal, a further input from the feedback controller during control may drive the actuator into saturation. Preferably, the control input from the feedback-controller is assumed to be constant over the prediction horizon. In particular, the optimization unit will thereby use a maximum amplitude of the control signal as a constraint that is lower than the maximum allowable amplitude of the control signal.

In a further possible embodiment, in normal operation, the optimization unit may use a change rate of the control signal that is below the maximum allowable change rate of the control signal as a constraint. Therefore, in normal operation, the acceleration of the actuator will stay below the maximum allowable acceleration, thereby keeping the strain on the crane structure low.

Further, the crane controller preferably comprises an emergency situation detection unit, and the optimization unit uses the maximum allowable change rate of the control signal as a constraint during emergency operation. This will make sure that the reference trajectory that is used for controlling the crane during an emergency situations will use the maximum acceleration that is available.

In particular, the emergency situation detection unit may detect if the input device is revised during a ride, which is also called "back-checking". This is the usual reaction of a crane operator if he anticipates a critical situation, and therefore a sign for an emergency situation.

The operation range of a crane is sometimes limited, for example in order to avoid collisions. Further, a crane can be used to move a load from a pre-defined first position to a pre-defined second position.

Some prior art approaches have tried to implement such position limitations as position constraints in the optimal control problem. However, the inventors of the present invention have realized that the optimal trajectories created in this way will not provide the desired trajectory, i.e. a trajectory that would reach the desired position as quickly as possible and only break the motion of the crane as late as possible.

In order to avoid these problems, in a possible embodiment of the present invention, the operator input will be automatically modified when the crane approaches a position limit. Thereby, position limits do not have to be entered as constraints in the optimal control problem, but these limits will enter into the control problem by modifying the operator input.

In particular, the operator input may be modified by a cut-off function when the crane is at a certain distance from the position limit. Therefore, as long as the crane is outside of a certain region around the position limit, the normal operator input will be used for the optimization problem. In contrast, when the crane enters the predefined region around the position limit, the operator input will be modified, and in particular will be set to zero. Thereby, the crane controller of the present invention will make sure that the trajectory that is generated will stop the crane motion before or at the position limit.

Preferably, the crane controller comprises a stopping prediction unit that predicts a crane position where the operator input has to be modified in order to stop the crane at or before the position limit. Thereby, one does not have to use a fixed distance from the position limit, but can use a position that is predicted depending on the circumstances of the operation of the crane.

In a preferred embodiment, the stopping prediction unit uses a look-up-table providing predefined stopping predictions depending on the state of the crane. Preferably, the look-up-table will provide the stopping prediction depending at least from slewing and/or luffing speed and/or rope deflection angle and/or rope deflection angle speed and/or rope length and/or current control signal. In particular the look-up-table will provide the stopping prediction depending on slewing and/or luffing speed and rope deflection angle.

According to the present invention, the optimization unit will solve the optimal control problem over a certain prediction horizon. This prediction is repeated at short intervals, because the operator input that enters into the control problem may change at any time. This is referred to as a repetitive optimal control.

Preferably, optimization is repeated at least every 300 ms, further preferably at least every 200 ms. Further, the prediction horizon may be at least 3 s, preferably at least 5 s. In a possible embodiment, the prediction horizon may be between 3 s and 30 s, preferably between 5 s and 20 s.

In order to solve the optimization problem, the prediction horizon is discretized. The number of the discretization steps is directly related to the calculation time that is necessary. Therefore, preferably, the number of discretization steps is below 30 in order to keep the calculation requirements low. Preferably, at least 3 discretization steps are used, further preferably at least 5, further preferably at least 10.

In a preferred embodiment of the present invention, the optimal control problem is solved in less than 150 ms, preferably in less than 100 ms. This will make sure that the crane reacts quickly to the input of the operator, such that the underlying optimization process is unnoticeable to the operator. However, if one wants to make sure that the optimal control problem is always solved within this time frame, very large safety margins have to be provided. Thereby, the quality of the control is deteriorated.

Therefore, according to a second aspect of the present invention, the present invention provides a crane controller for the semi-automatic control of a rotary crane comprising at least a slewing actuator for creating a slewing motion of the crane and/or luffing actuator for creating a luffing motion of the crane. The crane controller comprises an input unit which can be operated by an operator to provide a desired slewing speed and/or a desired luffing speed as an operator input and a model-predictive reference trajectory planning module comprising an optimization unit for calculating a reference trajectory that obeys the system dynamics and follows the operator input, and a feedforward-controller using the reference trajectory for controlling the slewing actuator and/or the luffing actuator. According to the second aspect of the present invention, the crane controller further comprises a fallback trajectory planning module, wherein the output of the fallback trajectory planning module is used by the feedforward-controller if the optimization unit of the model predictive reference trajectory planning module does not provide a reference trajectory within a predefined time frame. Thereby, the present invention makes sure that if no solution of the optimal control problem is found, or if there are any other problems in the model predictive reference trajectory planning module, the crane is still under control.

Further, the crane controller may comprise plausibility checking module for checking whether the trajectory provided by the model predictive reference trajectory planning module fulfills one or more plausibility criteria. In particular, the output of the fallback trajectory planning module is used by the feedforward controller if the trajectory provided by the model predictive reference trajectory planning module does not fulfill the plausibility criteria checked in the plausibility checking module. This will make certain that only plausible trajectories are used for controlling the crane, and if there are failures in the model predictive reference trajectory planning module, the fallback trajectory planning module is used for the control of the crane.

Preferably, the fallback trajectory planning module creates a trajectory that brings the crane to a steady state. This will increase the safety of the operation of the crane.

Further, the fallback trajectory planning module may comprise a deceleration part designed such that it will bring the crane to rest. Preferably, the deceleration part multiplies the current reference trajectory state with a gain matrix having one eigenvalue at zero and all other eigenvalues being stable.

Preferably, the fallback trajectory planning module creates a trajectory that steadily continues the trajectory from the model predictive reference trajectory planning module. Preferably, for this purpose, the fallback trajectory planning module may comprise a continuation part making sure that the crane does not abruptly change its behavior, or that unnecessary stress is created on the crane structure. Preferably, the continuation part takes into account the maximum allowable deceleration.

Preferably, the crane controller according to the second aspect of the present invention has the preferred features already described with respect to first aspect described above. In particular, the controller according to the second aspect may comprise these preferred features even if it does not use the first aspect, i.e. does not take into account the deflection of the rope during the optimization step.

However, in the most preferred embodiment, the first and the second aspect of the present invention are combined in a single controller.

Apart from the crane controllers described above, the present invention further comprises a rotary crane comprising such a crane controller. The crane according to the present invention preferably comprises a slewing tower that can be rotated by the slewing actuator and a boom pivotally mounted to the slewing tower that can be raised and lowered by the luffing actuator. Preferably, the crane further comprises a hoisting gear for raising and lowering a load hanging on a rope. Preferably, the rope is guided over a pulley at the tip of the boom, such that the load hanging on the rope will follow the movement of the tip of the boom with a pendulum dynamic.

The crane according to the present invention may be a moveable crane. In particular, the slewing tower may be mounted on an undercarriage, the undercarriage being drivable by one or more driving axes and/or crawler tracks.

The crane controller of the inventive rotary crane preferably has the features of the crane controller described above.

Further, the present invention comprises a computer program for implementing a crane controller as described above. In particular, the computer program may comprise code for implementing a crane controller on a crane computer of a rotary crane. The computer program of the present invention preferably is stored on a computer-readable memory.

The present invention further comprises a method for the semi-automatic control of a rotary crane, the crane comprising at least a slewing actuator for creating a slewing motion of the crane and/or a luffing actuator for creating a luffing motion of the crane. According to the present invention, an operator provides a desired slewing speed and/or a desired luffing speed as an operator input, and a model-predictive reference trajectory is planned by solving an optimization problem that provides a reference trajectory that obeys the system dynamics and follows the operator input. Further, the reference trajectory is used for feedforward control of the slewing actuator and/or the luffing actuator. According to a first aspect of the present invention, the deflection of the rope in the tangential and/or radial direction is taken into account when solving the optimization problem that provides the reference trajectory. According to a second aspect, a fallback trajectory is used for the feedforward control if the optimization problem cannot be solved within a predetermined time frame.

Preferably, the method of the present invention is performed as described above with respect to the inventive crane controller. Preferably, the method uses a crane controller as described above.

BRIEF DESCRIPTION OF THE DRAWINGS

The present invention will now be further described on the basis of a specific embodiment, which exemplifies the above described features with respect to the control of the slewing motion of the crane.

For exemplifying the invention, the following figures are used showing.

DESCRIPTION OF THE PREFERRED EMBODIMENTS

Two-degree-of-freedom control (2DOF), i.e. a combination of feedforward and feedback control, can give good tracking control performance on many large-scale robotic systems such as cranes. Every 2DOF control system needs a reference trajectory. The generation of this reference trajectory is crucial: Too slow reference trajectories decrease system performance, while too aggressive trajectories can easily violate state or input constraints. This degrades tracking performance and can even cause accidents. In case of operator-controlled rotary cranes, the trajectory generation needs to be done in real-time which limits the number of available algorithms.

For this purpose, as an embodiment of the present invention, a real-time repetitive optimal control trajectory planner for rotary cranes is presented. It takes input and state constraints into account. A fallback-strategy is provided in case no optimal control solution is found. The embodiment of the present invention is used for the two-degree of freedom control of a harbor mobile crane.

I. Introduction

Figure 1:
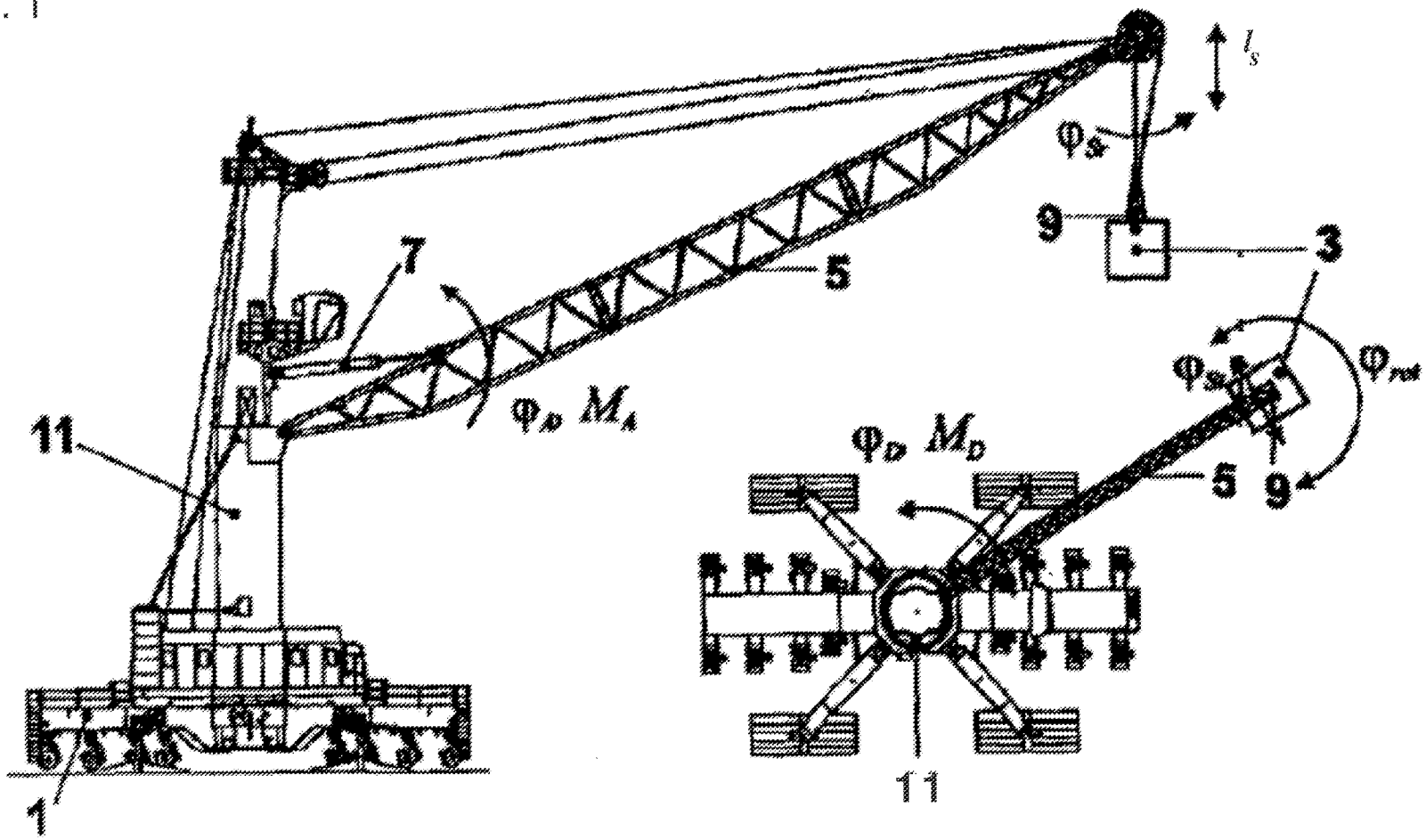
FIG. 1: an embodiment of a rotary crane according to the present invention.

An embodiment of a crane comprising a control system according to the present invention is shown in FIG. 1. The crane 1 comprises a tower 11 that can be rotated around a vertical slewing axis by a slewing gear. A boom 5 is pivotally attached to the tower 11, such that it can be raised an lowered around a horizontal luffing axis. As an actuator for the luffing motion, a hydraulic cylinder 7 is used in the embodiment. A load 3 is suspended on a rope 9 that is guided over a pulley at the tip of the boom 5. The crane comprises a hoisting winch for raising and lowering of the load 3 suspended on the rope.

Figure 2:
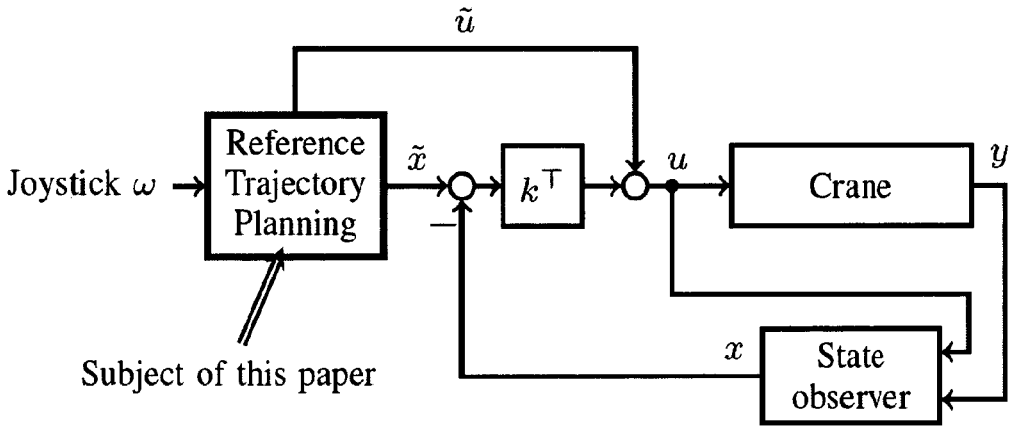
FIG. 2: a schematic diagram of a two-degree of freedom crane controller according to the present invention.

The crane control according to the present invention is semi-automatic, such that the operator uses a joystick to set a target velocity ω for the load. A control system needs to accelerate (or decelerate) the crane to this target velocity while compensating pendulum sway. In the embodiment of the present invention, two-degree of freedom control (2DOF) is used as shown in FIG. 2. The major benefit of 2DOF control is that the feedforward performance can be tuned separately from the feedback loop. To implement 2DOF control, a nominal control signal ũ and a nominal state trajectory x̃ need to be calculated by a so-called "trajectory planner". The control signal u is ultimately built from the nominal control signal and a stabilizing feedback, $$u=\tilde{u}+k^T(\tilde{x}-x). \tag{1}$$

Under nominal conditions the plant's state x perfectly tracks the planned trajectory x̃, which means that the stabilizing feedback is zero and the control signal u is dominated by the nominal control signal ũ. Trajectory generation is therefore an important task in 2DOF control.

The present embodiment focuses on how such nominal trajectories are planned for the slewing gear of rotary crane as shown in FIG. 1. However, the same approach could equally be used for the luffing actuator.

The description of the embodiment is organized as follows: In Section II, a slewing gear model is presented and requirements for nominal trajectories are specified. Also, the available computational resources are discussed. In Section III, an optimal control problem is deduced. This Section includes notes on the implemented solving method as well as a fallback strategy in case no optimal control solution can be found. Finally, operational examples for the control system of the present invention are presented in Section IV.

II. Problem Setup

A. Rotary Crane Model

Figure 3:
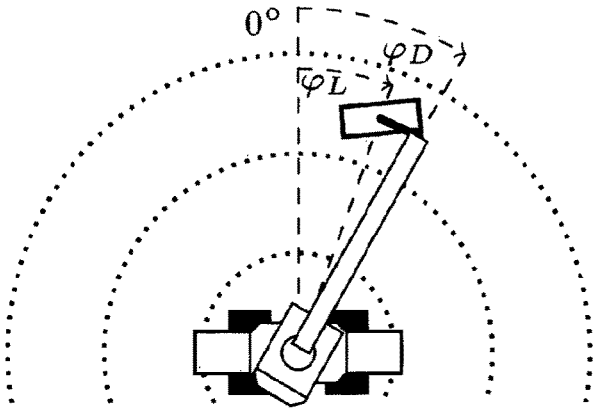
FIG. 3: a top view and a perspective view of a rotary crane showing the slewing position of the load and of the boom of the crane.
Figure 3:
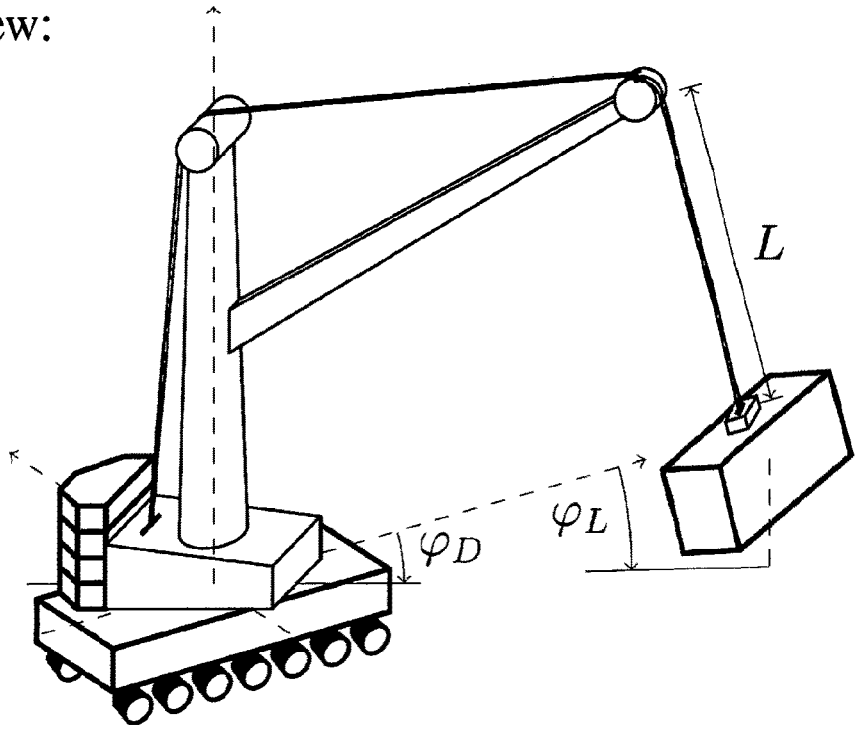

In this section, a linear dynamic model for the slewing dynamics of the crane and the pendulum is given. The rotary position of the tower and the load is denoted as $\varphi_D$ and $\varphi_L$ (see FIG. 3). Their angular velocities are therefore $\dot{\varphi}_D$ and $\dot{\varphi}_L$ The rope length is denoted as L and the gravitational acceleration is g. The slewing gear velocity $\dot{\varphi}_D$ follows the control input u with first-order lag dynamics. Assuming a time constant $T_D$, that is:

$$T_D\cdot\ddot{\varphi}_D+\dot{\varphi}_D=u. \tag{2}$$

The load always swings around the suspension point with an eigenfrequency of $\sqrt{g/L}$. That is:

$$L/g\cdot\ddot{\varphi}_L+\varphi_L=\varphi_D. \tag{3}$$

Combining (2) and (3) into a single state-space representation with the state vector definition $x=[\varphi_D, \dot{\varphi}_D, \varphi_L\ \dot{\varphi}_L]$ yields:

$$\dot{x}=\underbrace{\begin{pmatrix} 0 & 1 & 0 & 0 \\ 0 & -\frac{1}{T_D} & 0 & 0 \\ 0 & 0 & 0 & 1 \\ \frac{g}{L} & 0 & -\frac{g}{L} & 0 \end{pmatrix}}_{A} x+\underbrace{\begin{pmatrix} 0 \\ \frac{1}{T_D} \\ 0 \\ 0 \end{pmatrix}}_{B} u. \tag{4}$$

In the remainder of this paper, the presented u-x-dynamics are also used for planning the nominal trajectories ũ and x̃.

B. Requirements for Rotary Crane Trajectories

In this section, requirements for rotary crane trajectories are presented. For traceability reasons, the requirements are numbered.

Figure 4:
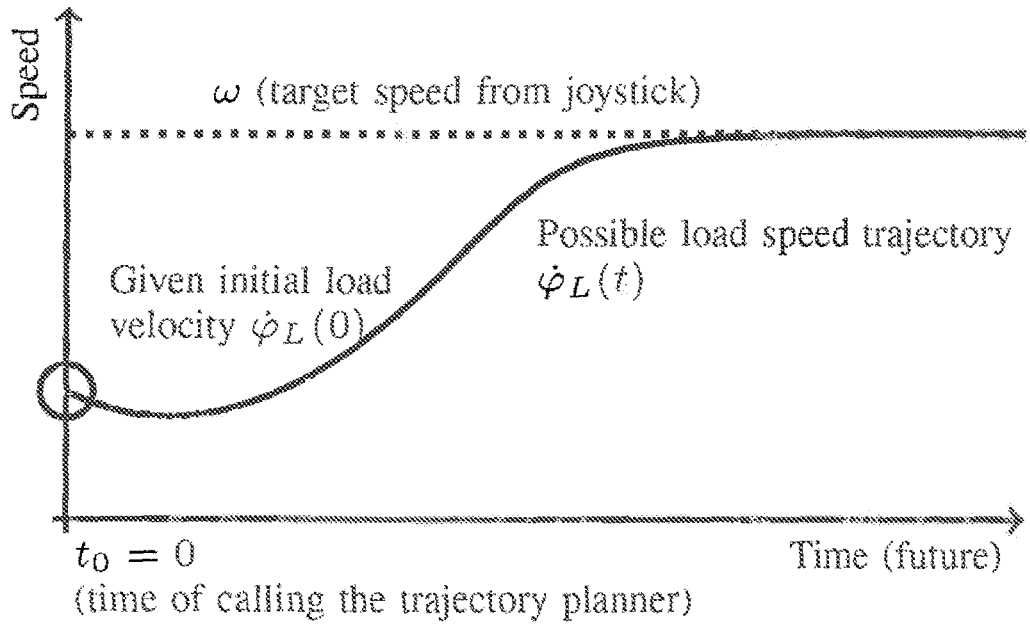
FIG. 4: an exemplary trajectory created according to the present invention.

R1 The general goal of any trajectory planning algorithm for semi-automated cranes is to calculate a load trajectory whose load speed smoothly converges to target velocity as shown in FIG. 4. The target velocity comes from the operator's joystick.

R2 Since the joystick position can change at any time, the trajectory needs to be replanned repeatedly from arbitrary initial conditions.

R3 The planned nominal trajectory needs to obey the system dynamics (4). Since the load position in (4) has a relative degree of r=4, any load trajectory will be 4-times continuously differentiable. This makes the trajectory smooth in a mathematical way.

There are also physical limitations to load trajectories. From the crane's mechanical construction and the hydraulic limits, these are:

R4 The amplitude of the control signal |u| needs to be bounded to the drivetrain's maximum speed.

R5 Changes of the control input yield mechanical stress on actuator components, therefore the input rate |u̇| has to be constrained.

R6 The pendulum deflection causes stress on the tower and the boom, so $$\left|\frac{\varphi_L-\varphi_D}{L}\right|$$

has to be bounded.

Additionally, there are non-technical requirements:

R7 For safe crane operation it is essential that the system behavior is predictable to the operator. Practical experience shows that near-steady-state operation is therefore advantageous, i.e. the pendulum deflection $$\left|\frac{\varphi_L - \varphi_D}{L}\right|$$

should always be minimized.

R8 Experience shows that the second derivative of the control signal correlates with structural vibrations of the crane. Therefore $|\ddot{u}|$ should be kept small to increase operator comfort and the acceptance of the control system.

Finally, there are functional requirements:

R9 A position constraint allows the control system to ensure that static obstacles in the workspace are not hit. Alternatively such a constraint can ensure that the crane approaches a given target position. Therefore the load position $\varphi_L$ itself also needs to be bounded.

R10 When a crane operator anticipates a critical situation, e.g. a collision, a natural reaction is to reverse the joystick during a ride, i.e. "back-checking". In such a situation, the planned trajectory needs to decelerate as quickly as possible.

C. Available Computational Resources

For the trajectory planning algorithm, the available dynamic memory is less restrictive than the computing power: Since the crane can only react to changed user input after the trajectory planning algorithm finished calculations, the acceptable reaction delay gives an upper bound on the acceptable calculation time. Experience shows that a few 100.000 floating-point operations can be performed in a background task on target hardware without noticeable delay to the operator. To allow sufficient safety margins, the trajectory planning algorithm should stay well below this number of floating-point operations.

III. Trajectory Planning Using Repetitive Optimal Control

Trajectory generation offers several degrees of freedom which can be chosen freely within certain constraints. In optimal control, a trajectory is generated which is optimal with respect to a cost function while fulfilling constraints. Many optimal control algorithms need significant computation time due to underlying BVP solvers or SQP solvers. Previous research indicates that it is possible to solve a single quadratic program (QP) using interior point algorithms (IP) with the given computational resources of the crane's control unit. Therefore the trajectory planning task is formulated as a finite-horizon linear-quadratic discrete-time optimal control problem (LQDOCP). The included crane model ensures that the planned trajectory satisfies the given system dynamics, which makes this a model-predictive trajectory planning approach. The optimization is repeated every 150 ms with updated initial conditions and an updated joystick position. This is referred to as repetitive optimal control. A similar approach is taken by.

A. Objective Function and Constraints

The chosen objective function sums up performance weights $J_{W,k}$ and slack variable weights $J_{S,k}$ for each time step k:

$$\min_{\tilde{x}_k, \tilde{u}_k, s_k} \sum_{k=0}^{K} J_{W,k} + J_{S,k}. \tag{5}$$

The performance weights $J_{W,k}$ quadratically penalizes deviations of the planned load velocity $\dot{\tilde{\varphi}}_L$ to the target velocity ω (R1). Since the joystick position cannot be predicted, ω is assumed constant over the full prediction horizon. The performance weights also penalize pendulums deflections $$\frac{\tilde{\varphi}_L - \tilde{\varphi}_D}{L}$$

and changes of the pendulum deflection $$\frac{\dot{\tilde{\varphi}}_L - \dot{\tilde{\varphi}}_D}{L}$$

(R7) as well as the curvature (second derivative) of the nominal control signal $\ddot{\tilde{u}}$ (R8):

$$J_{W,k} = \left\|\dot{\tilde{\varphi}}_{L,k} - \omega\right\|_{Q_{\dot{\varphi}}}^2 + \left\|\frac{\tilde{\varphi}_{L,k} - \tilde{\varphi}_{D,k}}{L}\right\|_{Q_{\Delta_{\varphi}}}^2 + \left\|\frac{\dot{\tilde{\varphi}}_{L,k} - \dot{\tilde{\varphi}}_{D,k}}{L}\right\|_{Q_{\Delta_{\dot{\varphi}}}}^2 + \left\|\ddot{\tilde{u}}_k\right\|_{Q_{\ddot{\tilde{u}}}}^2 \tag{6}$$

Since the control input curvature $\ddot{\tilde{u}}_k$ in (6) is not directly available as a state variable, it is approximated with a second-order backward difference quotient $\ddot{\tilde{u}}_k = \ddot{\tilde{u}}(\tilde{u}_{k-2}, \tilde{u}_{k-1}, \tilde{u}_k)$.

The state variables $\tilde{x}_k = [\tilde{\varphi}_D, \dot{\tilde{\varphi}}_D, \tilde{\varphi}_L\ \dot{\tilde{\varphi}}_L]$ have to fulfill the system dynamics. Therefore a zero-order hold discretization of (4) is included in the optimization problem:

$$\tilde{x}_{k+1} = A_k \tilde{x}_k + B_k \tilde{u}_k, k = 0 \ldots (K-1) \tag{7}$$

with a given initial condition $\tilde{x}_0$ (R2).

Next, the inequality constraints are presented. These are augmented with slack variables $s_k = (s_{1,k}, \ldots, s_{6,k}) \geq 0$ to avoid infeasibility problems. The state constraints for the pendulum deflection (R6) can be formulated in a straightforward way:

$$\frac{\tilde{\varphi}_L - \tilde{\varphi}_D}{L} - s_{1,k} \leq \Delta\varphi_{max}, \tag{8}$$

$$-\frac{\tilde{\varphi}_L - \tilde{\varphi}_D}{L} - s_{2,k} \leq \Delta\varphi_{max}, k = 1 \ldots K. \tag{9}$$

The nominal control input $\tilde{u}_k$ is bounded by input constraints (R4) and input rate constraints (R5). The input rate constraints are written as:

$$\tilde{u}_{k+1} - \tilde{u}_k - s_{3,k} \leq a_{max} \cdot (t_{k+1} - t_k), \tag{10}$$

$$-\tilde{u}_{k+1} + \tilde{u}_k - s_{4,k} \leq a_{max} \cdot (t_{k+1} - t_k), \tag{1}$$

with k=0 . . . (K−1).

The bound $a_{max}$ is chosen with some conservatism to smoothen crane operation. Only in emergency situations, i.e. when back-checking is detected, $a_{max}$ is set to its physical maximum (R10). For the control input constraints, a first approach could be to bound $\tilde{u}$ instead of u, i.e. $u_{min} \leq \tilde{u} \leq u_{max}$ This however turns out to be insufficient: When $\tilde{u}$ is at its maximum, additional stabilizing feedback from (1) could drive u into actuator saturation. Consequently, the control input constraints are written as $$\tilde{u}_k - s_{5,k} \leq u_{max} - k^T(\tilde{x}_0 - x(0)), \tag{12}$$

$$-\tilde{u}_k - s_{6,k} \leq -u_{min} + k^T(\tilde{x}_0 - x(0)), \tag{13}$$

for k=0 . . . (K−1). Here, the stabilizing control input $k^T(\tilde{x}_0 - x(0))$ is assumed constant over the prediction horizon.

To keep the slack variables $s_{1,k}$ . . . $s_{6,k}$ as small as possible, they are penalized in the cost function:

$$J_{S,k} = \sum_{j=1}^{6} Q_{s,j} s_{j,k}^2. \tag{14}$$

Weighting slack variables only quadratically yields small constraint violations whenever constraints become active. This is still accepted since strong linear slack variable weights empirically lead to undesirable increases in the number of IP iterations.

B. Discretization of the Planning Horizon

The optimal control problem is solved with an interior point (IP) algorithm which is presented in the following Section III-D. Each IP iteration requires a small multiple of $K(n_{\tilde{x}}^3 + n_{\tilde{u}}^3)$ floating point operations, where $n_{\tilde{x}}$ is the number of states and $n_{\tilde{u}}$ the number of input variables. It can be seen that the computational effort grows linearly with the number of discretization steps K. The choice of K requires a platform-dependent trade-off between the calculation time and the prediction accuracy.

C. Incorporating Position Constraints

When there is a position bound in the direction of motion, the expected behavior is that the crane drives normally as long as possible. Then it is expected to decelerate as if the target velocity was zero, resulting in a standstill right on the position bound. The optimal control problem set up in Section III-A does not allow obeying such a position bound (R9) so far.

It is not reasonable to include a position constraint like $\tilde{\varphi}_L \leq \varphi_{max}$ in the optimal control problem. Even though the constraint would be satisfied, the resulting trajectory would still be undesirable due to an inconsistency between the cost function and the position constraint. A small example helps comprehending the underlying problem:

Consider a plant to have simple integrator dynamics, i.e. x is a position and $\dot{x}$ a velocity. An linear-quadratic optimal control problem with a target velocity of $\dot{x} \rightarrow 1$, a prediction horizon of 10 s and a position constraint of $x \leq 3$ would look like this:

$$\begin{aligned} &\min_{x(t)} \int_0^{10s} (\dot{x}(\tau) - 1)^2 d\tau \\ &\text{s.t.} \quad x(0) = 0 \\ &\qquad x(t) \leq 3. \end{aligned} \tag{15}$$

Figure 5:
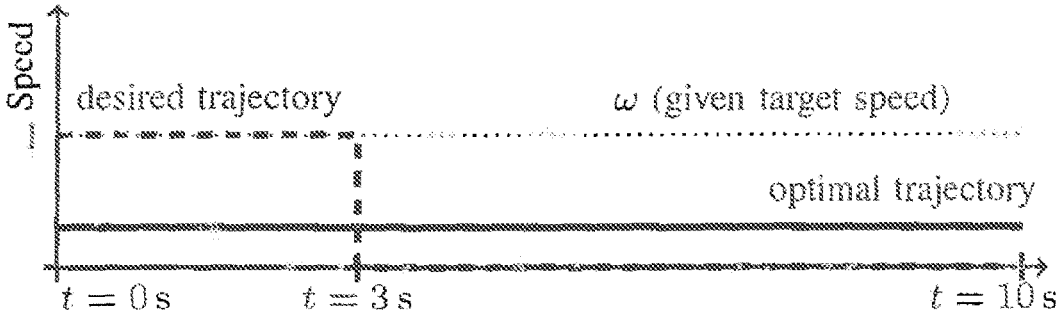
FIG. 5: a diagram showing an optimal trajectory using position constraints and a desired trajectory.

Both optimal control problems (6) and (15) have quadratic weights of velocity deviations. FIG. 5 shows both the desired trajectory and the optimal solution of the optimal control problem (15). It is infeasible to keep up the target velocity throughout the horizon due to the position constraint.

The desired trajectory keeps the target velocity of 1 for 3 s and rests at the target position afterwards. The optimal solution also covers a total distance of 3, but with an averaged velocity of 0.3 over the 10 s prediction horizon, only reaching the position bound at the end of the horizon. The underlying reason for this behavior is that quadratic cost functions penalize larger deviations of the planned velocity more than smaller ones. One workaround could be to contract the prediction horizon when approaching a target position. Such an algorithm would however require solving several QPs and therefore way more computation time.

Instead of using position constraints in the optimal control problem, (R9) is fulfilled by modifying the joystick target velocity ω in the objective function (6) with a cutoff function $f(\omega, \tilde{x}_0, L)$:

$$J_{W,k} = \left\| \dot{\tilde{\varphi}}_{L,k} - \underbrace{f(\omega, \tilde{x}_0, L)}_{\text{formally just } \omega} \right\|_{Q_{\dot{\varphi}}}^2 + \ldots \tag{16}$$

The cutoff function is defined as:

$$f(\omega, \tilde{x}_0, L) = \begin{cases} 0 & \text{if stopping prediction} \geq \varphi_{max} \wedge \omega > 0 \\ 0 & \text{if stopping prediction} \leq \varphi_{min} \wedge \omega < 0 \\ \omega & \text{else,} \end{cases} \tag{17}$$

where "stopping prediction" is an accurate prediction of the position where the crane comes to rest after a transient deceleration with ω=0. The prediction depends both on the initial state $\tilde{x}_0$ and the model parameter L, as well as on the trajectory planner dynamics. No analytic solution for predicting the stopping prediction was found. Therefore the stopping predictions for various combinations of initial states and rope lengths were calculated offline and stored in a lookup table. In the control system, the actual stopping prediction is determined from this lookup table using linear interpolation.

D. Solving the Optimal Control Problem

The presented finite-horizon linear-quadratic discrete-time optimal control problem consists of the cost function (5) with (6), (14), (16) and (17), the equality constraints (7) and the inequality constraints (8)-(13). It is solved with a standard Mehrotra-type predictor-corrector method. The most time-consuming step of this algorithm is the solution of a structured linear system of equations. To exploit structure, a discrete-time Riccati recursion is used.

E. Fallback Strategy

Figure 6:
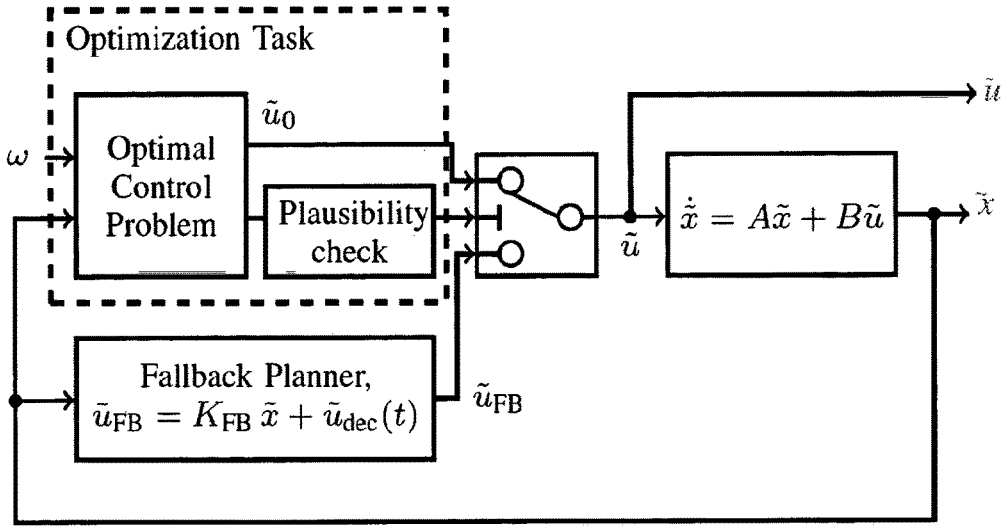
FIG. 6: a software block diagram of a trajectory planner including a failback planner according to the second aspect of the present invention.

It is possible that the optimal control problem cannot be solved. This might happen due to numerical problems, undetected algorithmic flaws, or if the computation time limit is exceeded (possibly due to higher-prioritized tasks on the same control unit). Therefore a number of checking algorithms monitor the convergence and plausibility of the solution of the optimal control problem. In case of failure, steady continuation of the planned state trajectory $\tilde{x}$ and the nominal control signal $\tilde{u}$ is still required to avoid sudden interruption of crane operation. FIG. 6 shows how this is accomplished: The planned state $\tilde{x}$ is integrated using the dynamic model (4). The nominal input $\tilde{u}$ is normally taken from the solution of the optimal control problem. If this is not available or fails to fulfill the plausibility checks, a fallback solution $\tilde{u}_{FB}$ is applied instead. This fallback solution is calculated by a combination of a deceleration part and a continuation function $\tilde{u}_{cont}(t)$:

$$\tilde{u}_{FB} = \underbrace{K_{FB}\tilde{x}}_{\tilde{u}_{dec}} + \tilde{u}_{cont}(t). \tag{18}$$

The gain matrix $K_{FB}$ is designed such that $(A+BK_{FB})$ has three asymptotically stable eigenvalues and one eigenvalue at $\lambda=0$. This means that the planned state $\tilde{x}$ converges to some (non-zero) stopping position while that the fallback planner is active. The deceleration part of the fallback control signal therefore ensures that the reference trajectory comes to rest. The continuation function $\tilde{u}_{cont}(t)$ is added to ensure that the control signal from the fallback planner $\tilde{u}_{FB}$ steadily continues the control signal $\tilde{u}$ from the optimal control problem before the transition. The function $\tilde{u}_{cont}(t)$ linearly reduces from its initial value to zero:

$$\tilde{u}_{cont}(t) = \begin{cases} \tilde{u}_{cont}(0) - a_{max}\cdot t & \text{if } \tilde{u}_{cont}(0) > 0 \wedge t < \dfrac{\tilde{u}_{cont}(0)}{a_{max}} \\ \tilde{u}_{cont}(0) + a_{max}\cdot t & \text{if } \tilde{u}_{cont}(0) < 0 \wedge t < \dfrac{\tilde{u}_{cont}(0)}{-a_{max}} \\ 0 & \text{else.} \end{cases} \tag{19}$$

The initial value is chosen as $$\tilde{u}_{cont}(0)=\tilde{u}-K_{FB}\tilde{x}, \tag{20}$$

with t=0 defined as the time instant of transition to the fallback planner. This choice of the initial condition (20) ensures that the fallback control signal is identical to the optimal control signal when the transition to the fallback planner occurs.

IV. Results

In this section, three scenarios are presented which demonstrate different functions of the trajectory planner. First, a simulation of a back-checking maneuver is shown during which rope angle constraints as well as input rate constraints become active. Second, a ride with various transitions between the optimal control problem solution and the fallback solution is presented. The third scenario was measured during a test on a crane as shown in FIG. 1. It shows how the crane stops at a position constraint even though the target velocity is non-zero.

A. Scenario 1: Back-Checking

Figure 7A:
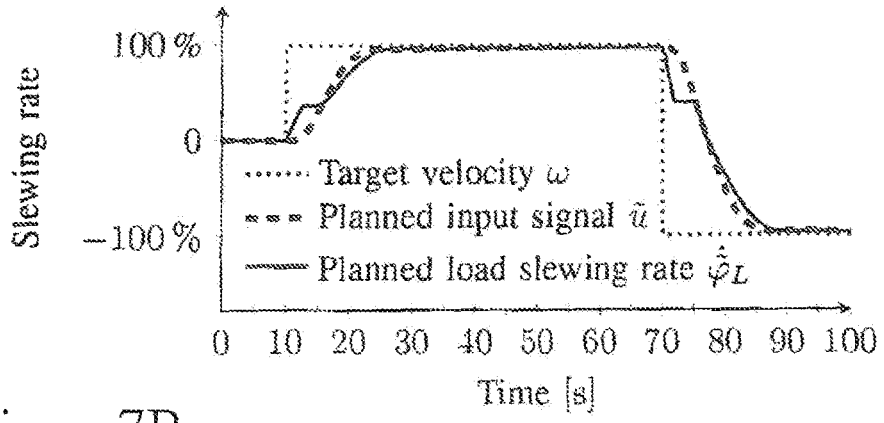
FIGS. 7A-C: three diagrams showing the slewing rate, the pendulum deflection of the rope and the iteration counter for an exemplary slewing gear ride where the target velocity is reversed (back-checking), such that several constraints become active during deceleration.
Figure 7B:
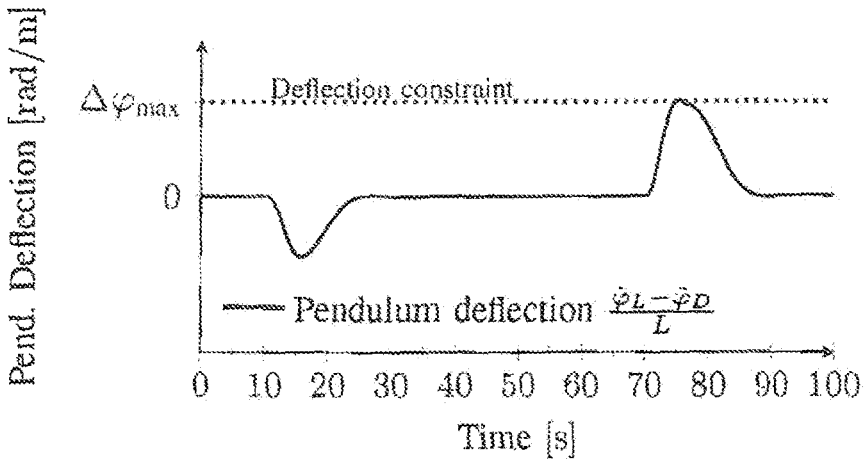
Figure 7C:
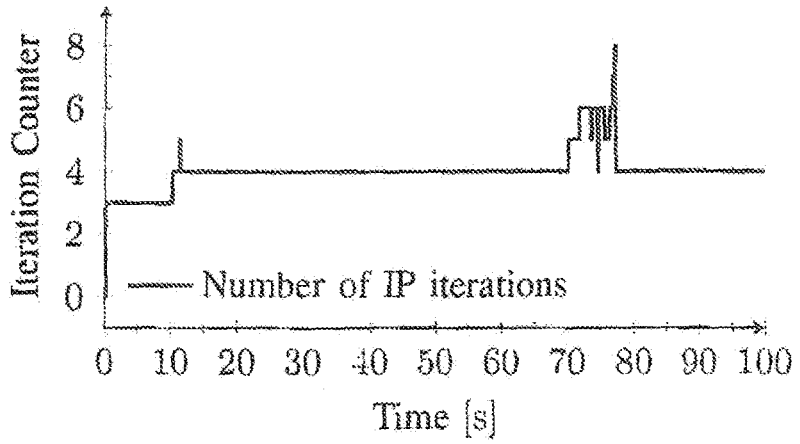
Figure 8:
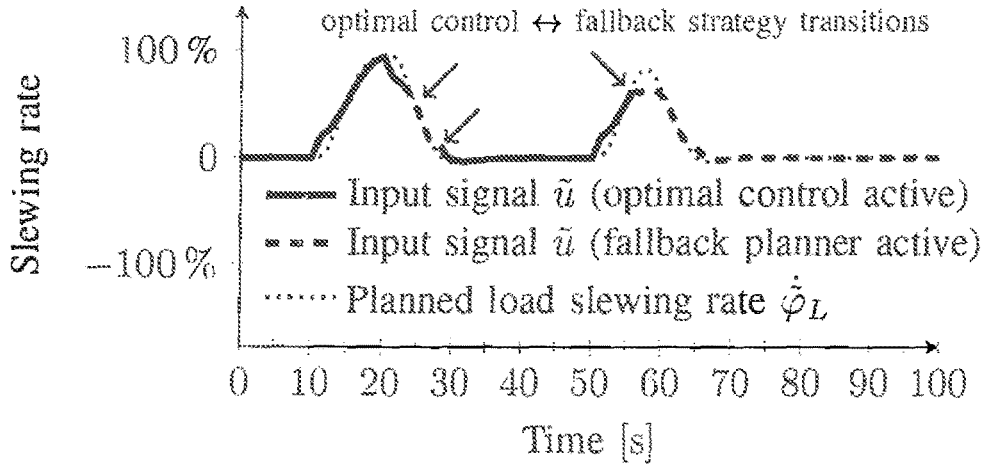
FIG. 8: a diagram showing a simulation of a slewing gear ride with multiple transitions between the optimal control solution and the fallback planner, and FIGS. 9A and B: two diagrams showing the slewing rate and the load position where position limits are implemented by modifying the target velocity according to the present invention.

FIG. 8 shows simulation results of a slewing gear ride at a rope length of L=65 m. At t=10 s, the target velocity is set to ω=+100%, see FIG. 7(*a*). Both the input signal $\tilde{u}$ as well as the load velocity $\dot{\varphi}_L$ converge to the target velocity within about 15 s. At t=70 s, the target velocity is reversed (ω=−100%). Once back-checking was detected, the $a_{max}$-constraint is widened which allows quicker deceleration. This yields higher pendulum deflections, see FIG. 7(*b*). At t=75.3 s, the maximum allowed pendulum deflection is reached. Afterwards the input signal is decreased further, converging to the new target velocity. FIG. 7(*c*) shows the IP iteration counter during this simulation. It can be seen that the algorithm needs most iterations when many constraints are active, i.e. when back-checking takes place.

B. Scenario 2: Transition to Fallback-Planner

FIG. 8 presents the control signal $\tilde{u}$ and the resulting slewing rate $\dot{\varphi}_L$ in a scenario where artificial transitions from the optimal control solution to the fallback planner occur. At every transition the control signal is continued smoothly. Also, if no transition back to the optimal control solution takes place (in FIG. 8 for t≥55 s), it can be seen that the fallback solution stabilizes the reference trajectory, bringing the crane into a safe steady state.

C. Scenario 3: Stopping at Position Constraints

The data presented in the third scenario (see FIG. 9) is not simulated but was captured during a test drive on a LHM 420 crane at a rope length of roughly L=35 m.

Figure 9A:
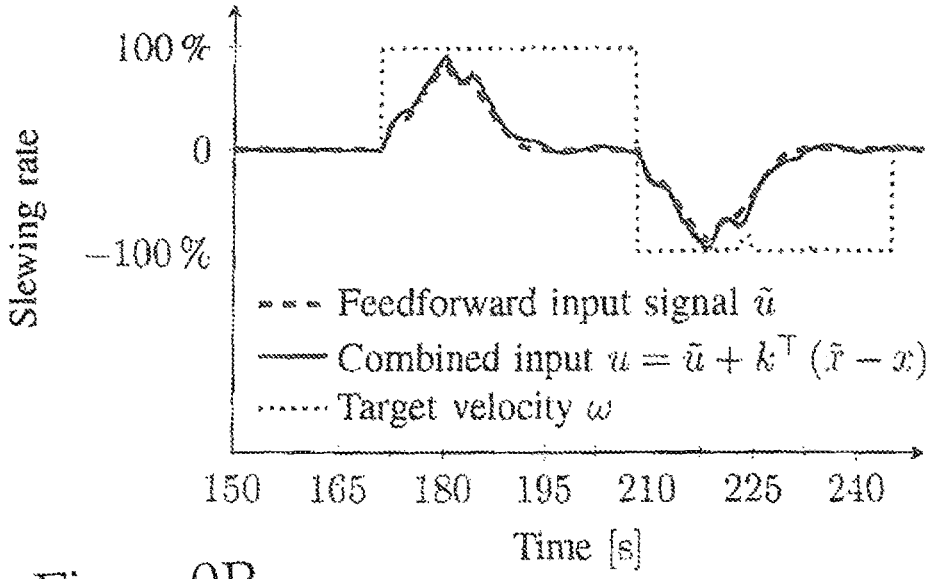
Figure 9B:
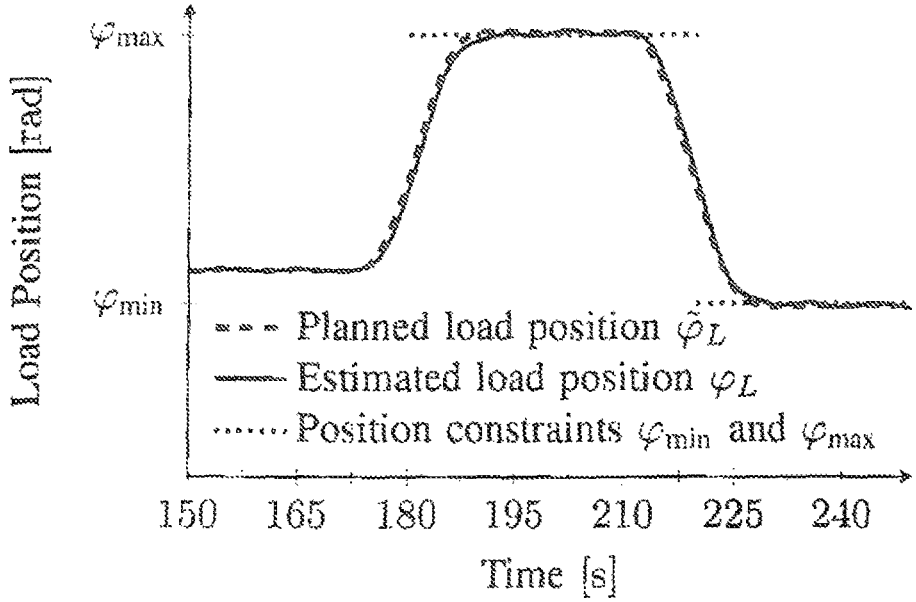
Figure 10:
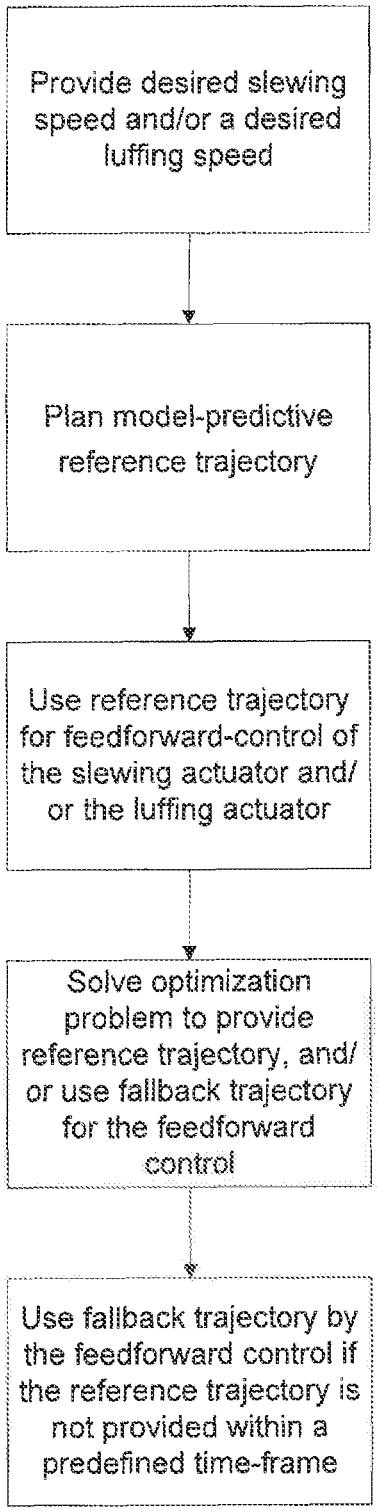
FIG. 10: is a diagram showing a method according to the present invention.

Artificial position constraints $\varphi_{min}\leq_L\leq\varphi_{max}$ were enabled. Afterwards the target velocity is set to ω=+100%, so the crane approaches the position constraint $\varphi_L=\varphi_{max}$ and comes to a standstill. Later the target velocity is set to ω=−100%, so the crane approaches $\varphi_L=\varphi_{min}$. FIG. 9(*b*) shows the good match of the planned load position to the real plant position, and subsequently FIG. 9(*a*) shows that the stabilizing control has only small amplitude, i.e. u is close to $\tilde{u}$.

V. Conclusion

As an embodiment of the present invention, a real-time constrained model-predictive reference trajectory planning algorithm for rotary cranes was presented. The algorithm generates a smooth trajectory which converges to a given target velocity. The trajectory is consistent with numerous physical limitations of a rotary crane. Also, comfort functions such as automatic deceleration ahead of positions bounds and stronger deceleration in emergency situations are realized. The trajectory was found by repeatedly solving an optimal control problem in real-time on an industrial control unit. In case the optimization algorithm gives no valid result, a fallback strategy ensures continuation of crane operation.

The invention claimed is:

1. A crane controller for semi-automatic control of a rotary crane, the crane comprising at least a slewing actuator for creating a slewing motion of the crane and/or a luffing actuator for creating a luffing motion of the crane, and the crane controller comprising an input unit which can be operated by an operator to provide a desired slewing speed and/or a desired luffing speed as an operator input, a model-predictive reference trajectory planning module comprising an optimization unit for calculating a reference trajectory that obeys the system dynamics and follows the operator input, and a feedforward-controller using the reference trajectory for controlling the slewing actuator and/or the luffing actuator, wherein the optimization unit takes into account deflection of a rope of the crane in a tangential and/or radial direction when solving an optimization problem that provides the reference trajectory, and the crane controller further comprises a fallback trajectory planning module, wherein the fallback trajectory planning module calculates a feedback solution based on a summation of a deceleration part and a continuation function, the feedback solution is used by the feedforward controller if the optimization unit of the model-predictive reference trajectory planning module does not provide the reference trajectory within a predefined time-frame, wherein the deceleration part is calculated to ensure reference trajectory comes to rest, and the continuation function linearly reduces from an initial value toward zero to prevent abrupt changes in operation of the crane.

2. The crane controller according to claim 1, wherein the optimization unit uses the maximum allowable deflection of the rope as a constraint when calculating the reference trajectory.

3. The crane controller according to claim 2, wherein the optimization unit uses a penalizing function for penalizing deflections of the rope and/or changes in the deflection of the rope when calculating the reference trajectory.

4. The crane controller of claim 3, wherein the crane controller further comprises, in combination with the feed-forward-controller, a feedback-controller using one or more sensors for generating signals for feedback-control of the crane, the feedback-controller comprising a state observer for estimating the state of the crane from the signals of the one or more sensors and control signals used for controlling the slewing actuator and/or the luffing actuator.

5. The crane controller of claim 4, wherein the optimization unit uses a maximum allowable amplitude of a control signal for the slewing actuator and/or the luffing actuator, and/or a maximum allowable change rate of the control signal for the slewing actuator and/or the luffing actuator as a constraint when solving the optimization problem that provides the reference trajectory.

6. The crane controller of claim 2, wherein the crane controller further comprises, in combination with the feed-forward-controller, a feedback-controller using one or more sensors for generating signals for feedback-control of the crane, the feedback-controller comprising a state observer for estimating the state of the crane from the signals of the one or more sensors and control signals used for controlling the slewing actuator and/or the luffing actuator.

7. The crane controller according to claim 1, wherein the optimization unit uses a penalizing function for penalizing deflections of the rope and/or changes in the deflection of the rope when calculating the reference trajectory.

8. The crane controller of claim 7, wherein the crane controller further comprises, in combination with the feed-forward-controller, a feedback-controller using one or more sensors for generating signals for feedback-control of the crane, the feedback-controller comprising a state observer for estimating the state of the crane from the signals of the one or more sensors and control signals used for controlling the slewing actuator and/or the luffing actuator.

9. The crane controller of claim 1, wherein the crane controller further comprises, in combination with the feed-forward-controller, a feedback-controller using one or more sensors for generating at least one control signal for feedback-control of the crane.

10. The crane controller of claim 9, wherein the optimization unit uses at least one of a maximum allowable amplitude of the at least one control signal for the slewing actuator and/or the luffing actuator, and/or a maximum allowable change rate of the at least one control signal for the slewing actuator and/or the luffing actuator as a constraint when solving the optimization problem that provides the reference trajectory.

11. The crane controller of claim 10, wherein the optimization unit takes into account, when using the maximum amplitude of the control signal as a constraint, a control input from the feedback-controller, and the control input from the feedback-controller is constant over a prediction horizon.

12. The crane controller of claim 10, wherein, in normal operation, the optimization unit uses a change rate of the control signal that is below the maximum allowable change rate of the control signal as a constraint, the crane controller further comprises an emergency situation detection unit, and the optimization unit uses the maximum allowable change rate of the control signal as a constraint during emergency operation.

13. The crane controller of claim 1, wherein the operator input is automatically modified when the crane approaches a position limit, the operator input is modified by a cut-off function when the crane is at a certain distance from the position limit, and/or the crane controller predicts a crane position where the operator input has to be modified in order to stop the crane at or before the position limit using a lookup-table providing predefined stopping predictions, depending from at least one of slewing, luffing speed, rope deflection angle, rope deflection angle speed, rope length, and current control signal.

14. The crane controller of claim 1, wherein an optimal control problem is solved at least one of over a prediction horizon of between at least one of 3 s and 30 s and 3 and 30 discretization steps and in less than 150 ms.

15. The crane controller of claim 1, further comprising a plausibility checking module for checking whether the trajectory provided by the model-predictive reference trajectory planning module fulfils one or more plausibility criteria, wherein the output of the fallback trajectory planning module is used by the feedforward controller if the trajectory provided by the model-predictive reference trajectory planning module does not fulfil the plausibility criteria checked in the plausibility checking module.

16. The crane controller of claim 1, wherein the fallback trajectory planning module creates at least one of a trajectory that brings the crane to a steady state and a trajectory that steadily continues the trajectory from the model-predictive reference trajectory planning module.

17. A rotary crane comprising the crane controller according to claim 1, the crane comprising a slewing tower that can be rotated by the slewing actuator and a boom pivotally mounted to the slewing tower that can be raised and lowered by the luffing actuator, and further comprising a hoisting gear for raising and lowering a load hanging on the rope.

18. The crane controller of claim 1, wherein the fallback solution $\tilde{u}_{FB}$ is calculated by:

$$\tilde{u}_{FB} = \underbrace{K_{FB}\tilde{x}}_{\tilde{u}_{dec}} + \tilde{u}_{cont}(t)$$

Where $K_{FB}\tilde{x}$ is the deceleration part, $K_{FB}$ is a gain matrix, $\tilde{x}$ is a planned state, and $\tilde{u}_{cont}(t)$ is the continuation function.

19. A computer program stored on a non-transitory computer-readable memory, for semi-automatic control of a rotary crane, the crane including at least a slewing actuator for creating a slewing motion of the crane and/or a luffing actuator for creating a luffing motion of the crane, comprising:

receiving from an input unit which can be operated by an operator to provide a desired slewing speed and/or a desired luffing speed as an operator input, calculating by a model-predictive reference trajectory planning module comprising an optimization unit for a reference trajectory that obeys the system dynamics and follows the operator input, and using by a feedforward-controller the reference trajectory for controlling the slewing actuator and/or the luffing actuator, wherein the optimization unit takes into account deflection of a rope of the crane in a tangential and/or radial direction when solving an optimization problem that provides the reference trajectory, and calculating by a fallback trajectory planning module a feedback solution based on a summation of a deceleration part and a continuation function, the feedback solution is used by the feedforward controller if the optimization unit of the model-predictive reference trajectory planning module does not provide the reference trajectory within a predefined time-frame, wherein the deceleration part is calculated to ensure the reference trajectory comes to rest, and the continuation function linearly reduces from an initial value toward zero to prevent abrupt changes in operation of the crane.

20. The crane controller of claim 19, wherein the fallback solution $\tilde{u}_{FB}$ is calculated by:

$$\tilde{u}_{FB} = \underbrace{K_{FB}\tilde{x}}_{\tilde{u}_{dec}} + \tilde{u}_{cont}(t)$$

Where $K_{FB}\tilde{x}$ is the deceleration part, $K_{FB}$ is a gain matrix, $\tilde{x}$ is a planned state, and $\tilde{u}_{cont}(t)$ is the continuation function.

21. A method for semi-automatic control of a rotary crane, the crane comprising at least a slewing actuator for creating a slewing motion of the crane and/or a luffing actuator for creating a luffing motion of the crane, wherein an operator provides a desired slewing speed and/or a desired luffing speed as an operator input, a model-predictive reference trajectory is planned by solving an optimization problem that provides a reference trajectory that obeys the system dynamics and follows the operator input, the reference trajectory is used for feedforward-control of the slewing actuator and/or the luffing actuator, the deflection of the rope in the tangential and/or radial direction is taken into account when solving the optimization problem that provides the reference trajectory, and/or a fallback trajectory is used for the feedforward control if the optimization problem can not be solved within a predefined time-frame, a fallback trajectory is used by the feedforward control if the reference trajectory is not provided within a predefined time-frame, wherein the fallback trajectory is based on a summation of a deceleration part and a continuation function, wherein the deceleration part is calculated to ensures the reference trajectory comes to rest, and the continuation function linearly reduces from an initial value toward zero to prevent abrupt changes in operation of the crane.

22. The crane controller of claim 21, wherein the fallback trajectory $\tilde{u}_{FB}$ is calculated by:

$$\tilde{u}_{FB} = \underbrace{K_{FB}\tilde{x}}_{\tilde{u}_{dec}} + \tilde{u}_{cont}(t)$$

Where $K_{FB}\tilde{x}$ is the deceleration part, $K_{FB}$ is a gain matrix, $\tilde{x}$ is a planned state, and $\tilde{u}_{cont}(t)$ is the continuation function.

* * * * *